US005265548A

United States Patent [19]

Satoma

[11] Patent Number: 5,265,548

[45] Date of Patent: Nov. 30, 1993

[54] THREAD TENSION APPARATUS

[75] Inventor: Shiro Satoma, Tokyo, Japan

[73] Assignee: Juki Corporation, Tokyo, Japan

[21] Appl. No.: 904,382

[22] Filed: Jun. 25, 1992

[30] Foreign Application Priority Data

Jun. 28, 1991 [JP] Japan ..... 3-159081

[51] Int. Cl.[5] ..... D05B 47/02

[52] U.S. Cl. ..... 112/254; 242/150 R

[58] Field of Search ..... 242/149, 150 R; 112/254, 302

[56] References Cited

U.S. PATENT DOCUMENTS 4,803,936 2/1989 Mikuni et al. ..... 112/254

5,156,105 10/1992 Wang ..... 112/254

*Primary Examiner*—Peter Nerbun

*Assistant Examiner*—Paul C. Lewis

*Attorney, Agent, or Firm*—Tarolli, Sundheim & Covell

[57] ABSTRACT

The thread tension regulating apparatus comprises; thread tension setting means for selecting and setting thread clamping pressure to the right pressure coping with plural kinds of the stitches; thread tension fine-adjusting means for allowing fine-adjustment of thread clamping pressure in the thread tension regulating apparatus by moving clamping pressure of the thread tension regulating apparatus from the original position to a higher position; said clamping pressure having been adjusted by said thread tension setting means; and home-position resuming means for returning the thread tension fine-adjusting means to the home position from another position when selecting and setting another thread tension by using the thread tension setting means.

5 Claims, 7 Drawing Sheets

THREAD TENSION APPARATUS

BACKGROUND OF THE INVENTION

1. Field of the Invention

This invention generally relates to a thread tension regulating apparatus for sewing machines. More particularly, the invention relates to an apparatus for allowing an adjustment dial to be returned to its preset home position.

2. Prior Arts

When sewing machines using plural kinds of sewing threads, such as overlocking machines, are used to form various stitches (overlock stitching, loop stitching, fancy stitching, etc.), it is necessary to control or adjust tension to be applied to each sewing thread depending upon the kind of stitches to be formed.

A thread tension regulating or balancing apparatus capable of controlling tension to be applied to sewing threads is disclosed, for example by the Japanese Patent Public Disclosure No. 02-255176.

FIG. 6 shows an overlock sewing machine of the single needle type in which one needle thread and two looper threads are used. A body 1 of the sewing machine includes, in its front surface, a thread tension regulating units 2A, 2B and 2C for controlling tension in a needle thread A, an upper looper thread B and a lower looper thread C, respectively. A thread tension in each thread tension regulating unit may be set independently at desired values by actuating a regulation dial 3.

As shown in FIG. 7, the thread tension regulating units are of the same mechanical construction. Accordingly, only a single thread tension regulating unit will be explained below.

When the tension regulation dial 3 is rotated in one direction, a gear portion 3' formed integrally with the regulation dial 3 will rotate a thread tension regulator (referred to as a thread tension regulating gear 5 hereinbelow) through an intermediate gear 4. The thread tension regulating gear 5 is threadingly engaged with a thread tension shaft 8 fixedly carried by a conversion shaft 9, so that the gear is displaced axially, whereby clamping pressure exerted by tension discs *7a* and *7b* is changed due to compression or elongation of a thread tension spring 6.

A thread take-up spring thread guard 10 moves in its axial direction by the rotation of a conversion cam 17 corresponding to its cam surface, wherein its movement in the axial direction is confined by a stop ring 11 which is fitted on the thread tension shaft 8. The conversion cam 17 is fixed on the conversion shaft 9, and supports the tension disc *7b* which is located at the opposite side of the thread tension spring 6.

Fixed to a base 12, are the thread tension shaft 8, fixed shafts 13 and 14, and a guide pin 15. The fixed shafts 13 and 14 are to support the regulation dial 3 and the intermediate gear 4, whereas the guide pin 15 is to prevent tension discs *7a* and *7b* as well as the thread take-up spring thread guard 10 from turning.

Reference numeral 16 designates a spring, and numeral 18 designates a conversion dial which is fixed on the conversion shaft 9. The spring 16 indicates the degree of thread tension when adjusting each thread tension unit to an adequate tension by the adjusting dial 3. The tension can be shown by aligning the standard scale (e.g. 5) of the scale *3b* (with numerals 1 through 9) with the indicator *3a*; The scale *3b* is printed on the outer periphery of the regulation dial 3.

In this thread tension regulating apparatus, projections 17' are provided on part of the conversion cam 17 which rotates together with the conversion shaft 9. The conversion shaft 9 is moved by the conversion dial 18 to adjust the tension of plural thread tension units. The thread take-up spring thread guard 10 moves in the axial direction, causing the tension disc *7b* which is on the opposite side of the thread tension spring 6 to move, and the clamping pressure of the thread tension discs *7a* and *7b* to change.

As explained above, each of the thread tension units can be manually adjusted by the regulation dial 3 when they are changed simultaneously.

Thread tension adjusting apparatuses of the aforementioned conventional type have the following problems.

When adjusting thread tension by the regulation dial to cope with changes of the sewing threads or sewing materials (hereinafter called the changes of the sewing mode), it is necessary to return the thread tension device to its original condition, i.e. the condition that provides a predetermined tension, for the next sewing after a sewing is finished. Returning the regulation dial, on which delicate adjustments have been made, to the original condition requires a complicated process that needs time and skills, causing a decreased efficiency of sewing work.

In addition, to see if the thread tension device has returned to its original condition, test sewing is needed, thus consuming unnecessary threads and sewing materials.

SUMMARY OF THE INVENTION

The thread tension regulating apparatus of this invention solves the foregoing problems by implementing:

thread tension setting means for selecting and setting thread clamping pressure to the right pressure coping with plural kinds of the stitches;

thread tension fine-adjusting means for allowing fine-adjustment of thread clamping pressure in the thread tension regulating apparatus by moving clamping pressure of the thread tension regulating apparatus from the original position to a higher position; the clamping pressure having been adjusted by the thread tension setting means; and home-position resuming means for returning the thread tension fine-adjusting means to the home position from another position when selecting and setting another thread tension by using the thread tension setting means.

The regulation dial of the thread tension device is returned to the preset home position by implementing:

thread tension setting means for selecting and setting thread clamping pressure to the right pressure coping with plural kinds of the stitches;

thread tension fine-adjusting means for allowing fine-adjustment of the thread clamping pressure in the thread tension regulating apparatus by moving clamping pressure of the thread tension regulating apparatus from the home position to another position; said clamping pressure having been adjusted by said thread tension setting means; and home-position resuming means for returning mechanically and/or electrically the thread tension fine-adjusting means from a position other than the home position back to the home position.

BRIEF DESCRIPTION OF THE DRAWINGS

To better understand the invention, and to show how the same may be implemented, reference will now be made, by way of example, to the accompanying drawings in which like reference numerals refer to like elements.

DETAILED DESCRIPTION OF THE INVENTION

Figure 1:
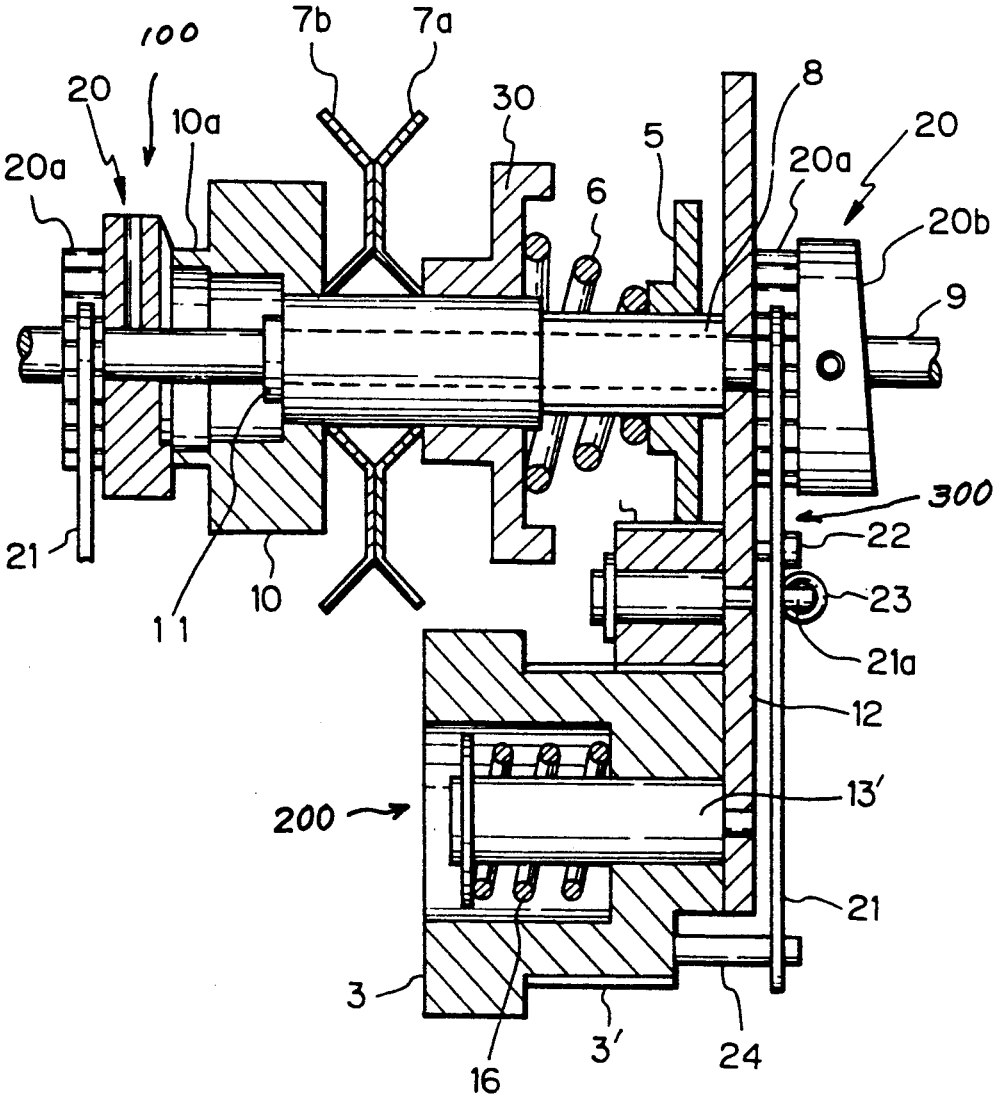
FIG. 1 is a cross-sectional view of an embodiment of a thread tension regulating apparatus of the mechanical type, according to the invention.
Figure 2:
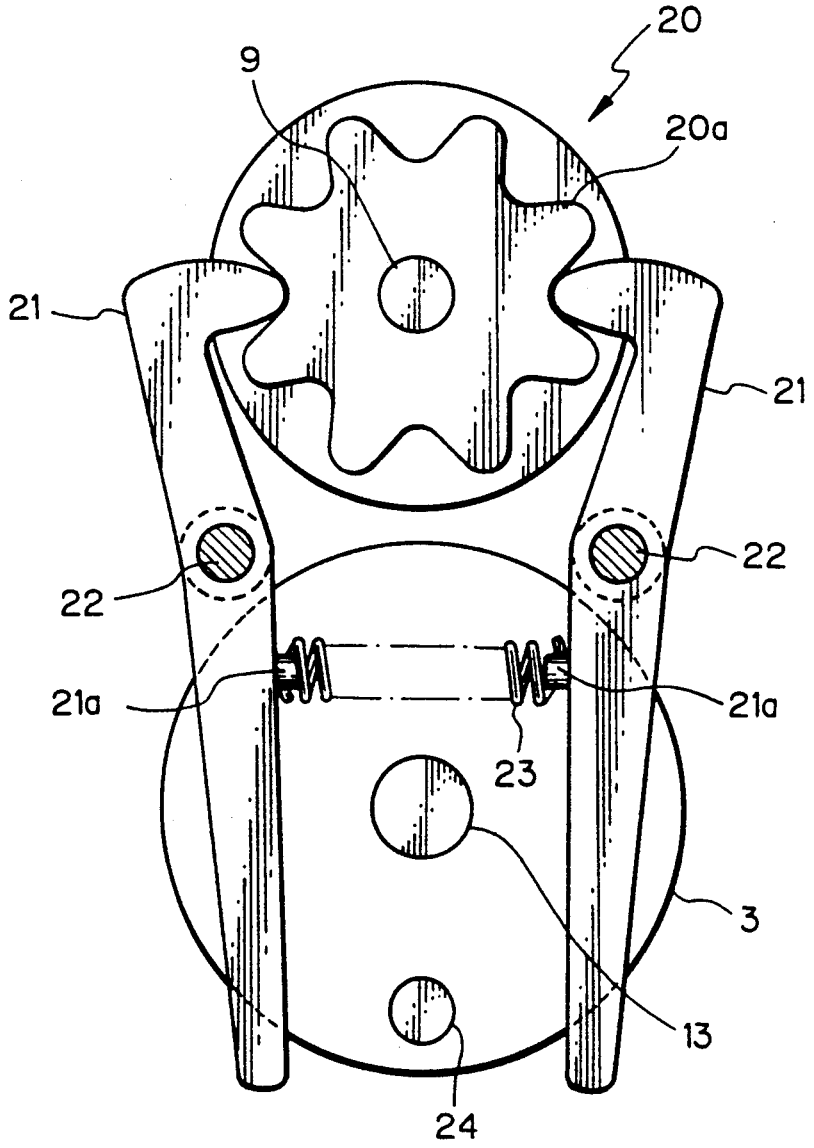
FIG. 2 is the major portion of a side view of the home-position resuming means of the thread tension regulating apparatus shown in FIG. 1.
Figure 3:
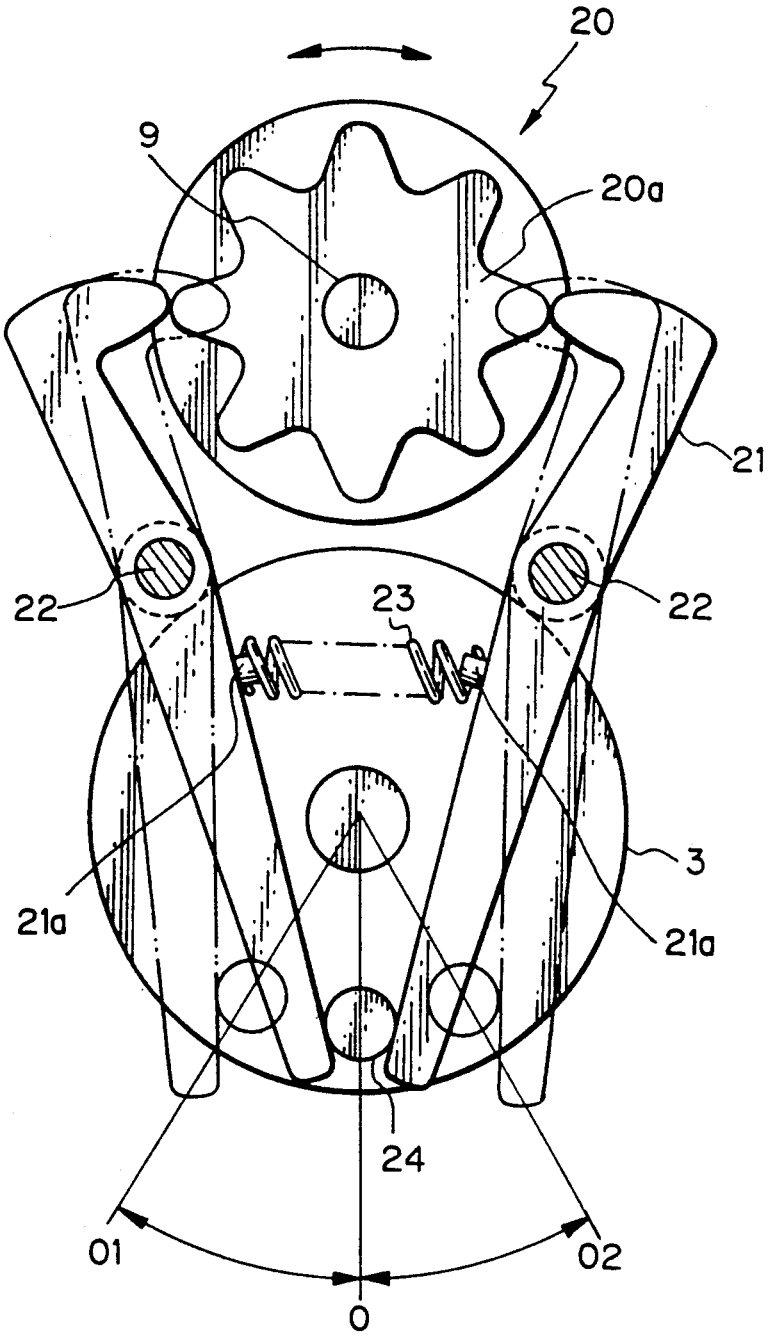
FIG. 3 is a diagram showing the operation of the home-position resuming means when the conversion shaft of the thread tension regulating apparatus shown in FIG. 1 is rotated.

The thread tension regulating apparatus of the present invention is shown in FIGS. 1 through 3. This thread tension regulating apparatus comprising thread tension setting means 100, thread tension fine-adjusting means 200 and home-position resuming means 300. The parts or components the same as those in the above prior art will be designated by the same reference numerals, and the detail of which will not be explained in order to avoid repetition.

The thread tension setting means 100, thread tension fine-adjusting means 200 and home-position resuming means 300 will be explained in detail below.

Reference numeral 20 designates a tension conversion cam. This tension conversion cam 20 consists of a cam surface 20*b*, which is of the conventional type, and a circular cam body 20*a* having a plurality of alternate protrusions and recesses. The cam 20 is secured, at the central portion thereof, to a conversion shaft 9, so as to be rotatable when a conversion dial 18 is rotated by the conversion shaft 9.

Reference numerals 21 and 21 designate a pair of rocking bodies located on both sides of the cam body 20*a*. In the illustrated construction, the rocking bodies 21 and 21 are rotatably supported by pins 22 and 22 secured to a base 12. One end (upper portion in FIG. 2) of each of the rocking bodies is engaged with one of the diametrically opposed recesses of the cam body 20*a* of the tension conversion cam 20 by means of tension of a spring 23 engaged at the ends thereof with spring pegs 21*a* and 21*a*.

As shown in FIG. 3, the other end of each of the rocking bodies 21 and 21 moves between a home position (original position) 0 and a position 01 or between the home position 0 and a position 02, due to the engagement with and disengagement from the recesses of the cam body 21*a* of the upper one end thereof upon rotation of the tension conversion cam 20.

The cam surface 20*b* and the cam body 20*a* of the tension conversion cam 20 are correspondingly designed so that, when overlock stitching is converted into loop stitching, for example, the cam surfaces 20*b* is rotated 45 degrees and the cam body 20*a* is also rotated 45 degrees, i.e., from the recess to another recess of the cam body.

Thus, the cam surface 20*b* and cam body 20*a* may be fixed separately to the conversion shaft 9, provided that the above corresponding design is maintained.

It is noted that, when the stitching pattern is changed, and thread tension suitable for a given stitching pattern may be obtained by rotating the tension conversion cam 20 secured to the conversion shaft 9 so that, due to the recesses and protrusions of the cam surface 20*b*, the tension disc 7*b* is displaced in the axial direction by means of the thread take-up spring thread guard 10 having protrusions 10*a*.

Fine adjustment after a desired stitching pattern has been obtained is done by rotating regulation dial 3 so as to rotate the thread tension regulating gear 5 due to the inter-engagement between the gear portion 3', and the intermediate gear 4 and the thread tension regulating gear 5.

Accordingly, and since the thread tension regulating gear 5 threadingly receives the thread tension shaft 8 in its central portion, the thread tension regulating gear is displaced in the axial direction. As a result, clamping pressure exerted by the tension discs 7*a* and 7*b* is changed due to the elongation or compression of the thread tension spring 6.

The regulation dial 3 is pivotable for a predetermined angle. After the stitching pattern has been changed, a movable body 24 connected to the regulation dial 3 is positioned, as shown in FIG. 2, on the center line between the rocking bodies 21 and 21, i.e., at the home position on the center line extending through the centers of the cam body 20*a* of the tension regulation cam 20 and the regulation dial 3.

The movable body 24 will be displaced from the home position when fine adjustment for thread tension is made. It is noted, however, that the movable body 24 is only movable to a point where the one end of the corresponding rocking body 21 is engaged with one of the recesses of the cam body 20*a*.

The conversion shaft 9, thread take-up spring thread guard 10, cam surface 20*b*, etc. cooperate to form thread tension setting means for selectively setting thread clamping pressure of the thread tension regulator at an appropriate value corresponding to one of the stitching patterns. The regulation dial 3 (gear portion 3' and movable body 24), thread tension regulating gear 5 etc. cooperate to form thread tension fine adjustment means for allowing fine adjustment of thread clamping pressure of the thread tension regulator. The cam body 20*a*, rocking bodies 21 and 21, axial pin 22, spring 23 etc. cooperate to form home-position resuming means for returning the thread tension fine adjustment means at a position other than the original position (home position) to the original position (home position).

Operation of the device for returning the regulation dial of the thread tension regulator to the home position as constructed above will be explained below with reference to FIG. 3.

When it is intended to return the regulation dial 3 to the home position after the amount of tension to be applied to the sewing thread is changed by means of the regulation dial 3, the conversion shaft 9 is rotated in the clockwise or counter-clockwise direction by altering the stitch mode.

By the foregoing rotation, the tension conversion cam 20 rotates and moves the other end of the rocking bodies 21 and 21 to move toward the center portion, forcing the movable body 24, which is located either on the right or left, to move to the center as shown in FIG. 3.

Due to the above-mentioned movement, the regulation dial 3 can be moved to the preset home position (original position) together with the movable body 24.

Figure 6:
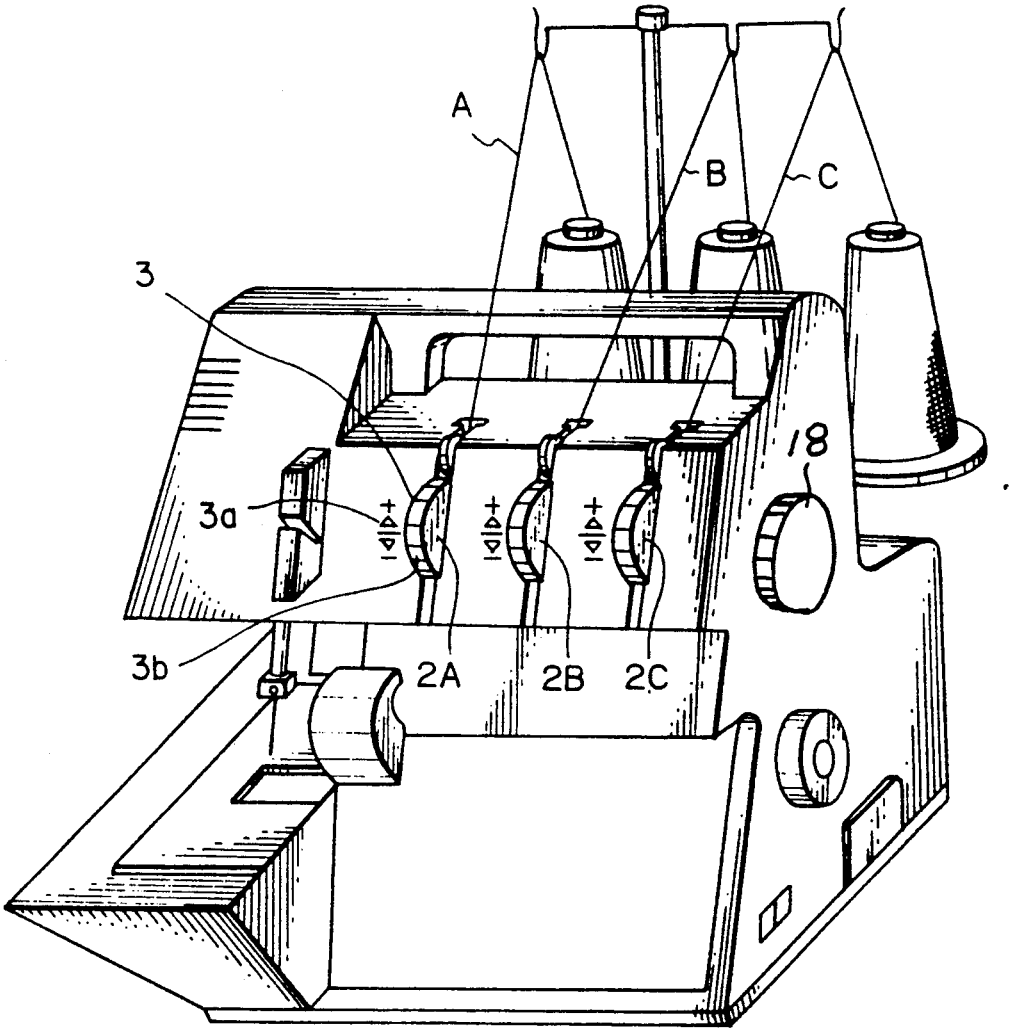
Fig. 6 (PRIOR ART)
FIG. 6 is a solid diagram showing an overlock sewing machine equipped with a plurality of conventional thread tension units.

A plurality of the thread tension regulating apparatus of the foregoing construction may be used, wherein plural cams 20*a* (three of them in FIG. 6) are used with one conversion shaft 9 so that plural thread tension apparatus can simultaneously be returned to the home position by the rotation of one conversion shaft 9.

Figure 4A:
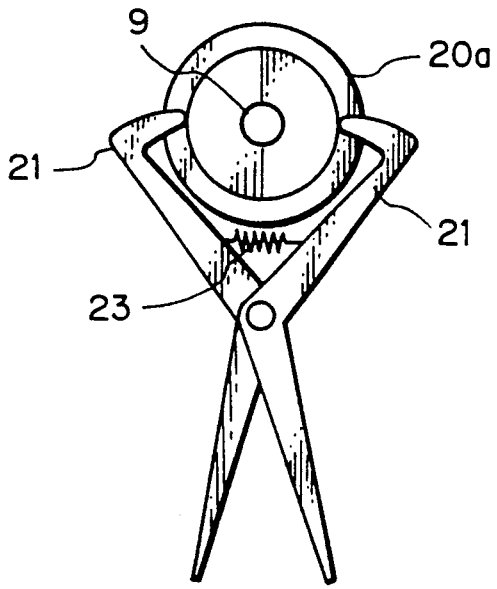
FIGS. 4(*a*), 4(*b*), and 4(*c*) illustrates another embodiment with a variation of the movable body shown in FIGS. 2 and 3.
Figure 4B:
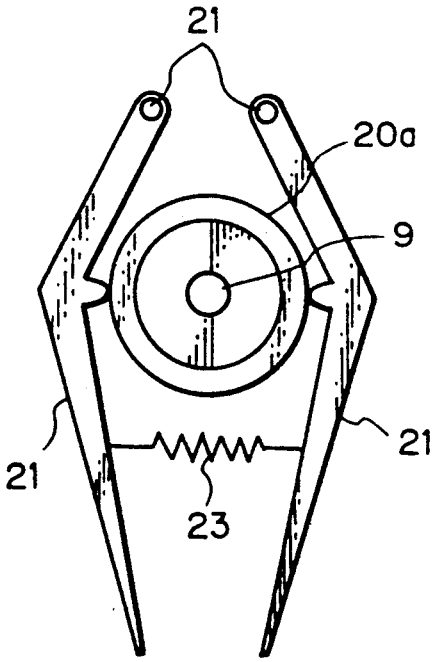
Figure 4C:
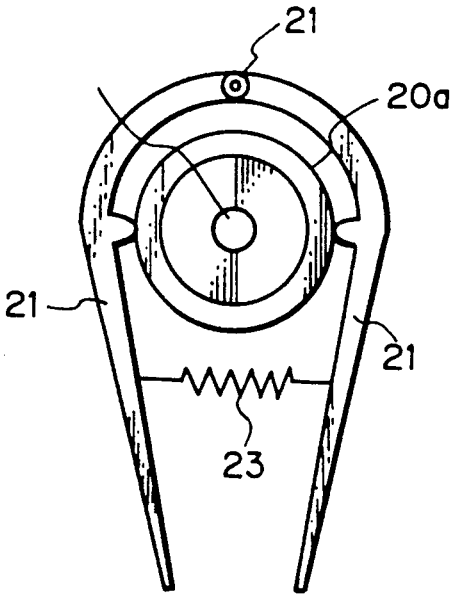
Figure 5A:
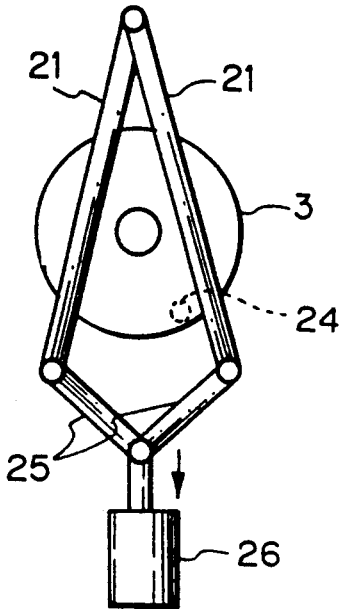
FIGS. 5(*a*), 5(*b*), 5(*c*), and 5(*d*) show another embodiment of home-position resuming means of the electrical type.
Figure 5B:
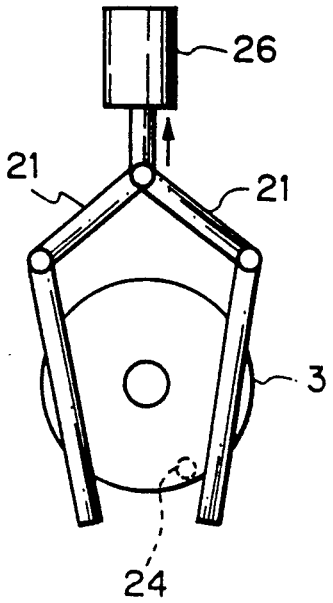
Figure 5C:
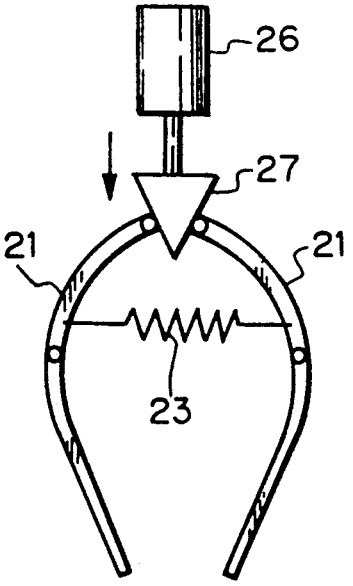
Figure 5D:
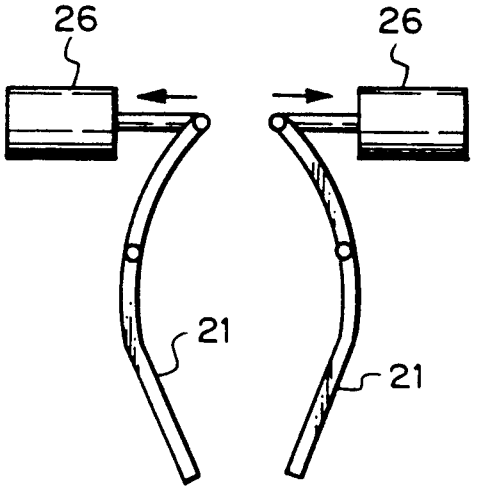

FIG. 4 shows some variations of the rocking bodies 21 and 21 of the foregoing embodiment.

FIG. (a) is a variation in which the movable body 24 is returned to the home position by the elasticity of the spring 23 as the cam 20*a* moves from a protrusion to a recess when shifting to the next stitching pattern.

FIGS. (b) and (c) are variations in which the moving body 24 is returned to the home position by the elasticity of the spring 23 as the cam 20*a* moves from a recess to a protrusion when shifting to the next stitching pattern.

Home-position resuming means of the mechanical type was explained in the foregoing FIGS. 2, 3 and 4. The same of the electrical type may be used as shown in FIG. 5. In this embodiment, FIG. (a) shows rocking bodies 21 and 21 with one end pivoted and the other connected to the ends of links 25 and 25; the other ends of the links 25 and 25 are pivoted, to which a solenoid 26 is connected, causing the solenoid 26 to move to the direction of the arrow.

FIG. (b) shows rocking bodies 21 and 21 with one end pivoted, to which a solenoid 26 is connected, causing the solenoid 26 to move to the direction of the arrow.

FIG. (c) shows rocking bodies 21 and 21 with a spring 23 connected with tension to their upper part. One end of each of the rocking bodies 21 and 21 is connected to a tapered piece 27 to which a solenoid 26 is attached. The solenoid 26 moves to the direction of the arrow.

FIG. (d) shows rocking bodies 21 and 21 with one end pivoted to a solenoid 26, causing the solenoid 26 to move to the direction of the arrow.

Figure 7:
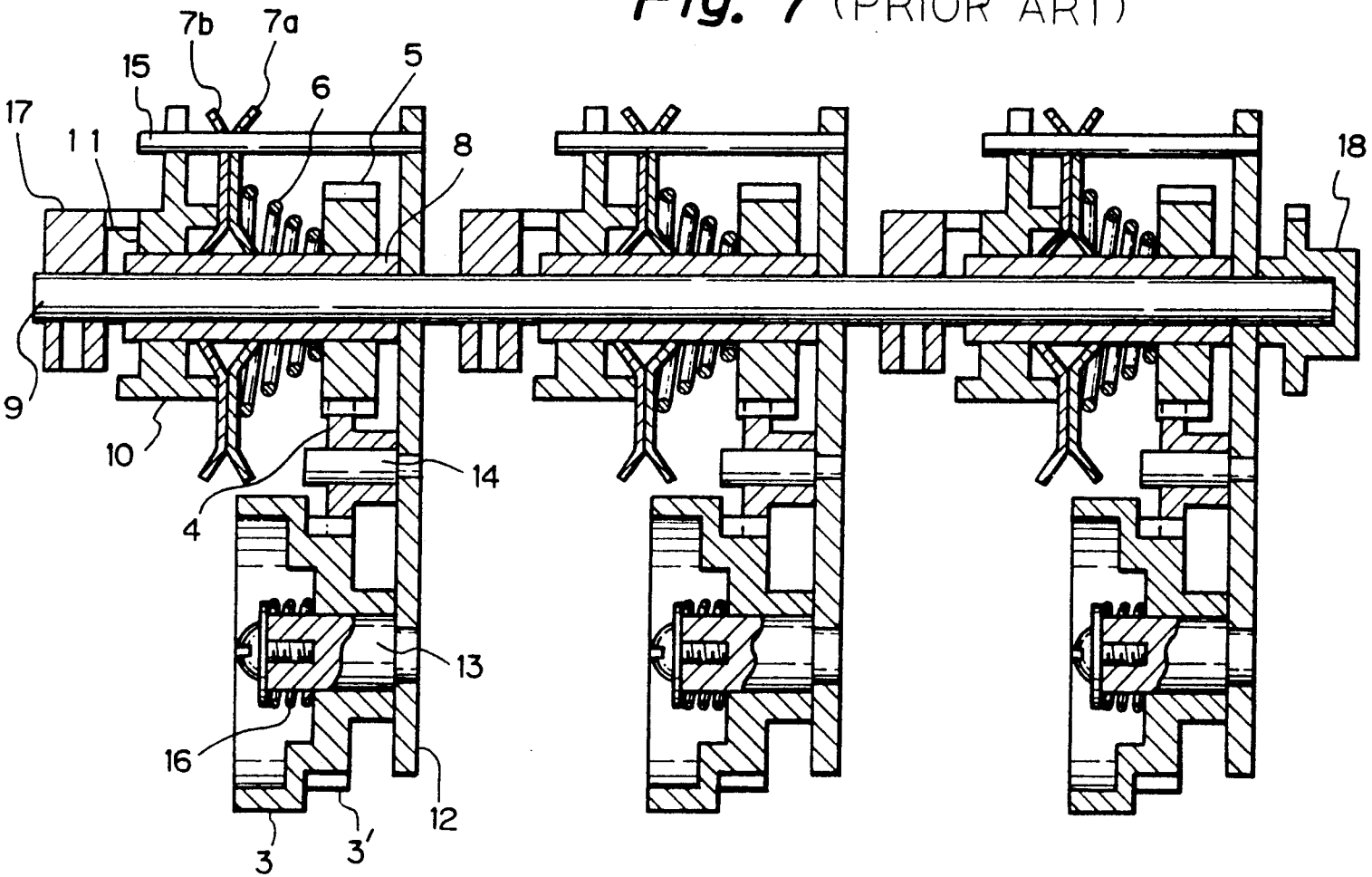
Fig. 7 (PRIOR ART)
FIG. 7 is a sectional view showing the construction of the thread tension unit built-in the overlock sewing machine shown in FIG. 6.

In FIGS. (a), (b), (c) and (d), each solenoid is equipped with a signal emitter, which is not shown in the figure, but is located close to the conversion dial 18 as shown in FIG. 7. The signal emitter generates a signal when a new stitching pattern is selected by rotating conversion dial 18, and transmits the signal to the solenoid 26.

A regulation dial 3 may be connected directly or indirectly to a motor in order to drive it according to the aforementioned signal. This embodiment is not illustrated here.

The same advantage as in the aforementioned embodiment can be achieved in other embodiments explained referring to FIGS. 4 and 5.

As explained in the foregoing paragraphs, the thread tension regulating apparatus of the present invention comprises:

thread tension setting means for selecting and setting thread clamping pressure to the right pressure coping with plural kinds of the stitches;

thread tension fine-adjusting means for allowing fine-adjustment of the thread clamping pressure in the thread tension regulating apparatus by moving clamping pressure of the thread tension regulating apparatus from the home position to a higher position; said clamping pressure having been adjusted by the thread tension setting means; and home-position resuming means for returning mechanically and/or electrically the thread tension fine-adjusting means from a position other than the home position back to the home position.

Because of the implementation of the above means, the regulation dial for thread tension, which is on a point other than the home position, can be returned to the home position quickly and easily, enhancing efficiency in sewing work, and eliminating unnecessary consumption of threads and sewing materials for test sewing.

What is claimed is:

1. A thread tension apparatus for use in applying tension to thread during the sewing of a plurality of different stitch formations, said apparatus comprising:

a thread tension unit for clamping a thread to apply tension thereto;

first thread tension setting means for selecting a stitch formation and setting said thread tension unit to apply a preset thread tension corresponding to the selected stitch formation;

second thread tension setting means for modifying the preset thread tension applied by said thread tension unit to an optional tension and setting said thread tension unit to apply the optional tension; and means for nullifying the setting made by said second thread tension setting means in response to a change in the stitch formation selected by said first thread tension setting means so as to provide a preset thread tension corresponding to one of said stitch formations.

2. A thread tension apparatus for use in applying tension to thread during the sewing of a plurality of different stitch formations, said apparatus comprising:

a plurality of thread tension units for clamping a plurality of threads to apply tensions thereto;

first thread tension setting means for selecting thread tensions for said plurality of thread tension units and setting said thread tension units to preset thread tensions corresponding to stitch formations;

second thread tension setting means for modifying said preset thread tensions applied by said plurality of thread tension units to optional tensions and setting said thread tension units to apply the optional tensions; and means nullifying the settings made by said second thread tension setting means in response to a change in the stitch formation selected by said first thread tension setting means so as to provide preset thread tensions corresponding to one of said stitch formations.

3. A thread tension apparatus comprising:

a plurality of thread tension units for clamping a plurality of threads to apply tensions thereto;

first thread tension setting means for selecting thread tension for said plurality of thread tension units and setting said thread tension units to preset thread tensions;

second thread tension setting means having an original condition where a tension in each of said thread tension units is a preset thread tension, said second thread tension setting means being operable to a second condition in which at least some of said thread tension units settings are changed to modify at least some of said preset thread tensions to optional tensions; and means for returning said second thread tension setting means to the original condition upon selection of other thread tensions by said first thread tension setting means.

4. A thread tension apparatus as claimed in claim 3 wherein said means for returning said second thread tension setting means is adapted to return said second thread tension setting means to the original condition by rotating a cam element in association with setting of said first thread tension setting means.

5. A thread tension apparatus as claimed in claim 2 wherein said means for returning said second thread tension setting means is adapted to return said second thread tension setting means to the original condition by drive means electrically operable in association with setting of said first thread tension setting means.

* * * * *